US005187534A

United States Patent [19]

Iwata et al.

[11] Patent Number: 5,187,534

[45] Date of Patent: Feb. 16, 1993

[54] STAPLING DEVICE AND IMAGE FORMING APPARATUS HAVING A STAPLING DEVICE

[75] Inventors: Yasuhiro Iwata; Shuzo Tsubo, both of Kanagawa, Japan

[73] Assignee: Kabushiki Kaisha Toshiba, Kawasaki, Japan

[21] Appl. No.: 707,334

[22] Filed: May 29, 1991

[30] Foreign Application Priority Data

May 31, 1990 [JP] Japan ..... 2-142037

[51] Int. Cl.[5] ..... G03G 15/00

[52] U.S. Cl. ..... 355/324; 227/155; 270/53

[58] Field of Search ..... 355/208, 308, 324; 227/2, 3, 5, 155; 270/37, 53

[56] References Cited

U.S. PATENT DOCUMENTS 2,083,227 10/1933 Drypolcher ..... 227/155
4,366,924 1/1983 Leiter ..... 227/155
4,994,865 2/1991 Nishimori et al. ..... 355/324
5,029,745 7/1991 Akizawa et al. ..... 227/155

FOREIGN PATENT DOCUMENTS 62-186278 8/1987 Japan ..... 355/324
2-86552 3/1990 Japan ..... 355/324
2-86554 3/1990 Japan ..... 355/324

*Primary Examiner*—Joan H. Pendegrass
*Attorney, Agent, or Firm*—Foley & Lardner

[57] ABSTRACT

A device for stapling sheets at a stapling zone includes a conveyor for conveying the sheets to be collated to the stapling zone, a detector for detecting the overall thickness of sheets conveyed by the conveyor to the stapling zone, a first stapler for stapling the sheets collated at the stapling zone, and a second stapler for stapling the sheets collated at the stapling zone. In the device, one of the first and second staplers is selected to be actuated in accordance with the overall thickness of the stack of sheets detected by the detector.

5 Claims, 12 Drawing Sheets

STAPLING DEVICE AND IMAGE FORMING APPARATUS HAVING A STAPLING DEVICE

BACKGROUND OF THE INVENTION

1. Field of the Invention

The present invention relates to a device for stapling sheets, and to an image forming apparatus equipped with this device, that effects stapling of the sheets by suitable bending of a staple in accordance with the stapling thickness of the sheets.

2. Description of the Related Art

A staple, e.g., so-called Hotchkiss, is widely used as a simple method of binding sheets, such as for example printed sheets or copies. There are various devices for carrying out this process, from simple hand-operated tools to devices using a motor. Their action consists in moving a staple pressing member and an anvil towards each other, so that a staple which is positioned between them is pressed and formed by bending so as to pierce and fix the sheets.

FIG. 15 shows a commonly used anvil 101. This is provided with recesses 102 and 103 arranged in a straight line and having a separation and a shape of their curved bottom surfaces matched to the staple. By this means, the staple is bent inwards so that stapling is achieved as the staple tips are brought up close to each other.

Thus staples must be used in stapling that match the thinkness of the sheaf of sheets that are to be stapled. As shown in FIGS. 16A and 16B, when staples 105, 106 are used that match the thicknesses of the sheaf of sheets to be stapled t1 and t2, suitable pressing margins a and b are formed. However, if, as shown in FIG. 17A, staple 105 is too large in relation to stapling thickness of the sheaf of sheets t1, the portion c that is bent over to provide the pressing margin is too long, with the result that the tips of the staple come into contact with each other. The staple therefore bows outwards. If, on the other hand, as shown in FIG. 17B, staple 105 is too short in relation to stapling thickness of the sheaf of sheets t2, the portion d that is bent over to provide the pressing margin is too short, with the consequence that it cannot be properly pressed over. This leads to a failure to grip the sheets properly, with the result that the sheets may become detached during handling.

In recent years, a stapling device attached to an electronic copier have been provided wherein after copying, the copy sheets are stacked in a sorter so that stapling can be performed on a prescribed number of sheets at a time.

In fact, there is a wide range in the total thickness of stacks of sheets to be stapled, from a few sheets to a fairly thick stack. All these are processed by the same stapling device, so sheets do become detached when the stack is too thick for the staples used. This can be prevented by using staples which are on the large side, but if they are too large, as described above, their tips come into contact resulting in bowing making the stapled sheaf of sheets difficult to handle.

SUMMARY OF THE INVENTION

It is an object of the present invention to provide a device for stapling sheets, and to an image forming apparatus equipped with this device, that always effects suitable stapling even though the thickness of the sheaf of sheets to be stapled is varied.

According to the present invention there is provided a device for stapling sheets at a stapling zone, comprising means for conveying the sheets to collate the sheets at the stapling zone, means for detecting the overall thickness of sheets conveyed by the conveying means to the stapling zone, first stapler means for stapling the sheets collated at the stapling zone, second stapler means for stapling the sheets collated at the stapling zone, and means for selecting one of the first and second stapler means in accordance with the overall thickness of sheets detected by the detecting means.

Further according to the present invention there is provided an image forming apparatus for forming an image of a document on a sheet, comprising means for conveying the sheet on which is formed the image to be collated at a stapling zone; means for receiving an information designating the overall thickness of sheets conveyed by the conveying means to the stapling zone; first stapler means for stapling a set of sheets collated at the stapling zone; second stapler means for stapling a set of sheets collated at the stapling zone; and means for selecting one of the first and second stapler mean in accordance with the information received by the receiving means.

Still further according to the present invention there is provided an image forming apparatus including means for feeding documents, means for forming an image of the document on a sheet, and means for conveying the sheets on which respectively formed images to be collated at the stapling zone, the apparatus comprising means for detecting the number of documents fed by the feeding means to determine the overall thickness of sheets collated at the stapling zone; first stapler means for stapling the sheets collated at the stapling zone; second stapler means for stapling the sheets collated at the stapling zone; and means for selecting one of the first and second stapler means in accordance with the overall thickness of sheets determined by the detecting means.

DETAILED DESCRIPTION OF THE PREFERRED EMBODIMENTS

Referring to the accompanying drawings, a detailed description will subsequently be given of the preferred embodiments of the present invention.

An image forming apparatus of this embodiment comprises a main unit A wherein the images are formed on the sheets, and a stapling device B operatively connected to main unit A for stapling the sheets discharged from the main unit A.

Figure 1:
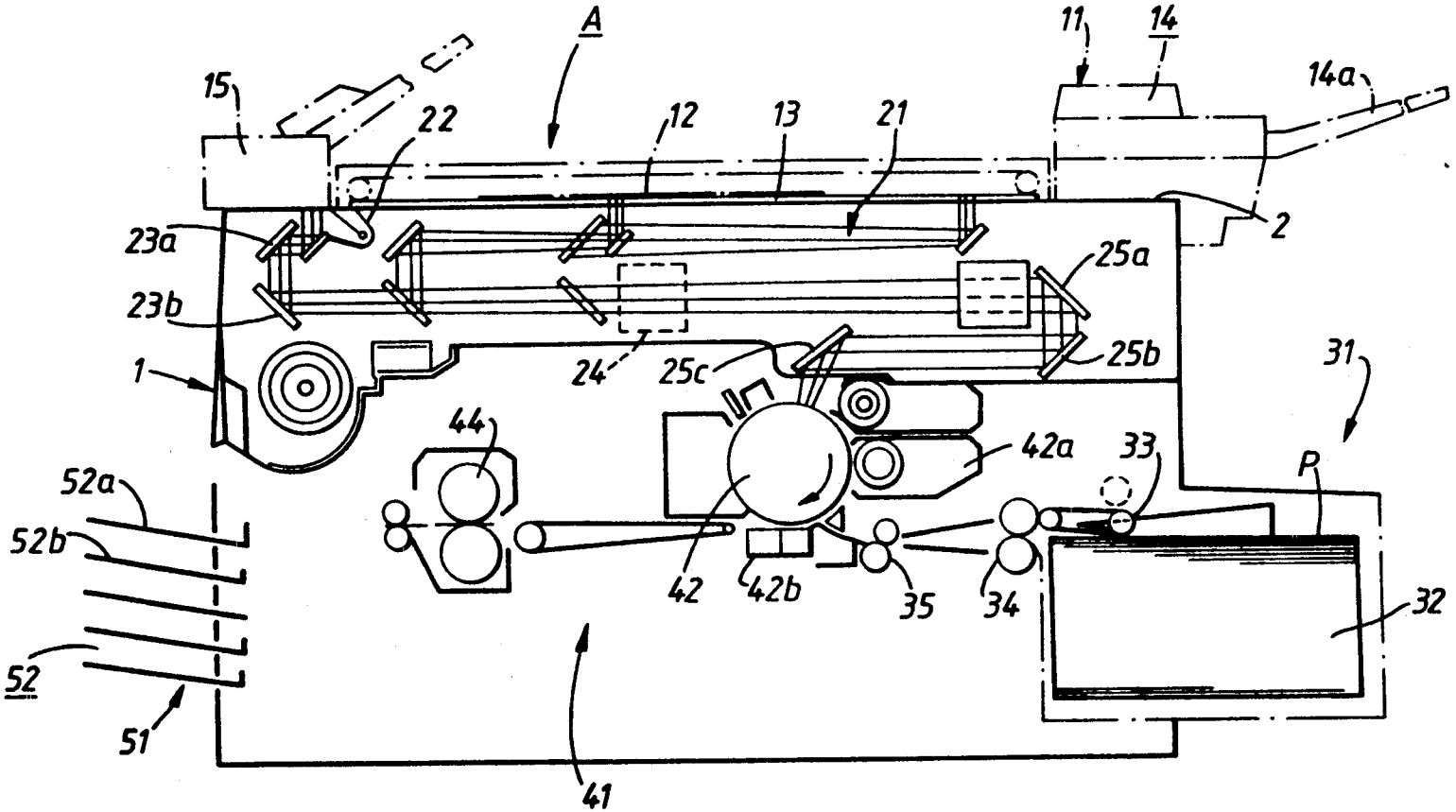
FIG. 1 shows the structure of an image forming apparatus provided with a stapling device according to the present invention.
Figure 5:
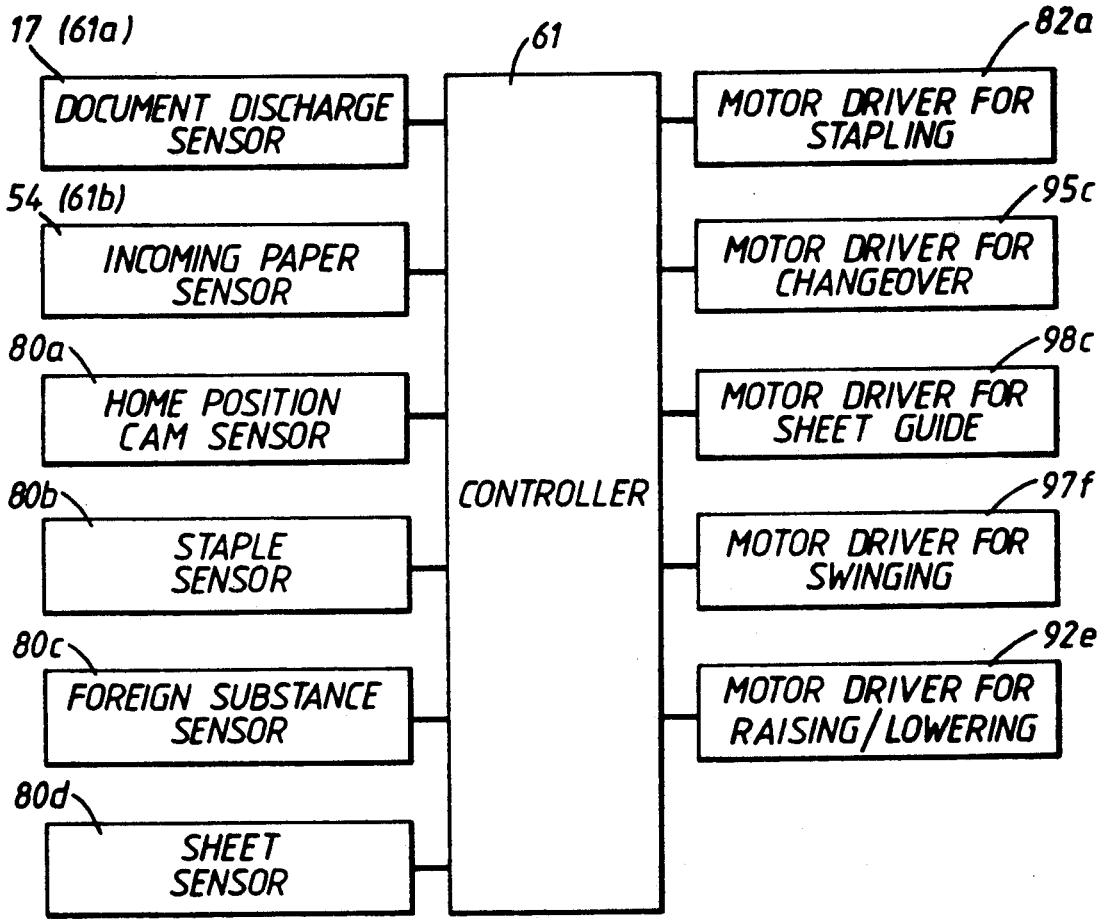
FIG. 5 is a block diagram showing a control system for the stapling device.

As shown in FIG. 1, main unit A comprises a main body 1, document feeding unit 11, exposure scanning unit 21, sheet feeding unit 31, image forming unit 41, sheet discharging unit 51, and controller 61 (FIG. 5).

Although not shown in detail an operating panel 2 is provided at the front part of the top face of main body 1. The desired number of copies is input from this operating panel 2 by an operator.

Document feeding unit 11 is provided with a document platen 13 on which a document 12 can be laid. A document feeder 14 is mounted on one side of the document platen 13, and a document discharge unit 15 is mounted on the other side.

Figure 2:
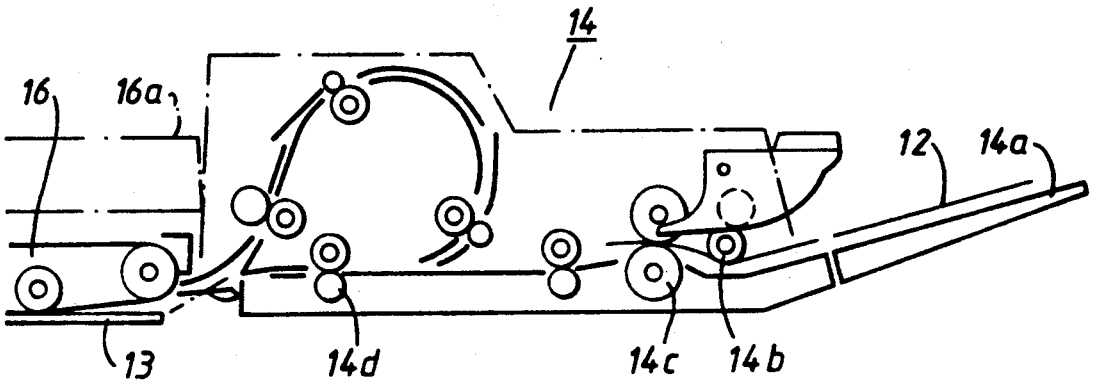
FIG. 2 is a segmental view of a document feeder equipped with the image forming apparatus shown in FIG. 1.

As shown in FIG. 2, document feeder 14 is equipped with a feed tray 14*a* on which documents 12 can be laid. Documents 12 laid on feed tray 14*a* are fed in by means of a pick-up roll 14*b* and pass through a feeding and separating roll pair 14*c*, which feeds them one at a time through aligning roll pair 14*d* onto document platen 13. A document feeding member 16 consisting to a conveyor belt is also arranged above document platen 13. Document feeding member 16 serves to feed and locate the document 12 in a prescribed position. This document feeding member 16 is mounted on document cover 16*a* and is integrally opened and closed therewith.

Figure 3:
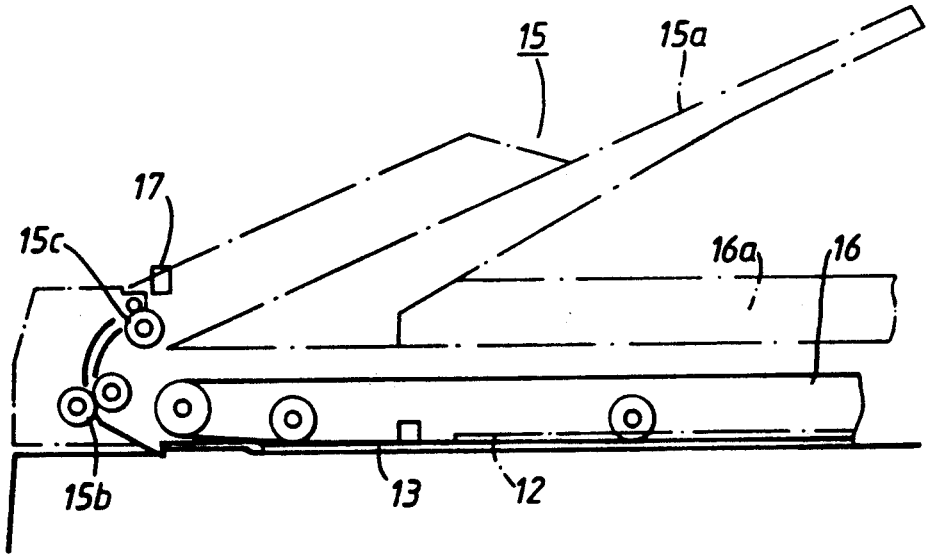
FIG. 3 is a segmental view of a document discharge unit equipped with the image forming apparatus shown in FIG. 1.

As shown in FIG. 3, document discharge unit 15 is equipped with a document receiving tray 15*a* so that when an exposed document 12 is discharged by document feeding member 16, document 12 is discharged to document receiving tray 15*a* through feed roll 15*b* and discharge roll 15*c*. In this time, discharge of the document is detected by a document discharge sensor 17, which delivers a signal that is input to a controller 61, to be described.

Returning to FIG. 1, exposure scanning unit 21 includes a moving light source 22, moving reflecting mirrors 23*a* and 23*b*, lens 24, and fixed reflecting mirrors 25*a*, 25*b*, and 25*c*.

An image of document 12 is formed by lens 24 on photosensitive drum 42 by the scanning movement of light source 22.

Sheet feeding unit 31 supplies sheets P as image carriers, and is provided with a large sheet supply unit 32. A sheet P extracted by pick-up roll 33 arrive at aligning roll pair 35 through feeding and separating roll pair 34 and is fed to photosensitive drum 42.

Image forming unit 41 is equipped with rotating photosensitive drum 42. The image of document 12 that is formed on photosensitive drum 42 is an electrostatic latent image. This electrostatic latent image is developed by a developing device 42*a* to be converted into a visible image on photosensitive drum 42. The visible image is transferred onto sheet P by a transfer device 42*b*, and is fixed on sheet P by a fixing roll pair 44. Finally sheet P is fed to sheet discharging unit 51.

Figure 4:
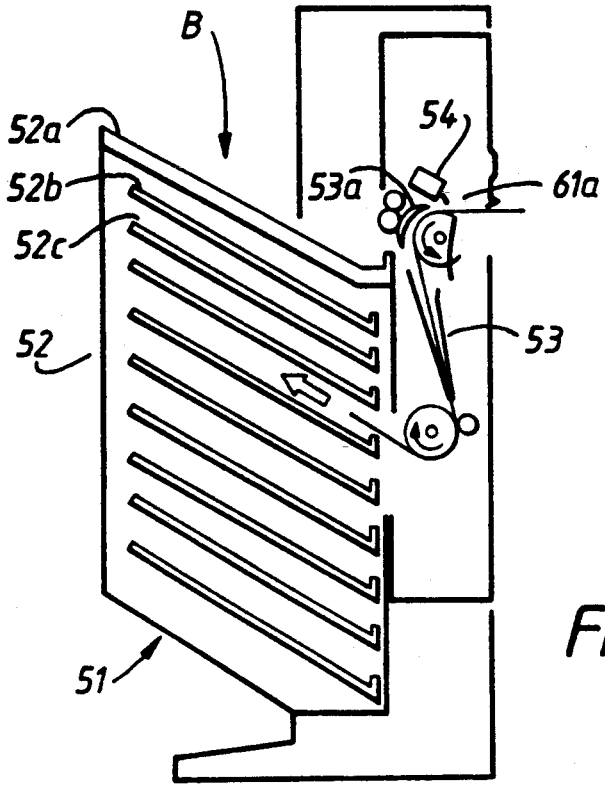
FIG. 4 shows the structure of a sheet discharging unit in which a stapling device of the present invention is equipped.

As shown in FIG. 4, Sheet discharging unit 51 comprises a bin unit 52 that is moved vertically, having multiple bins 52*a*, 52*b*, . . . , and an intake feed path 53.

When guided downwards as shown by changeover guide 53*a*, incoming sheets p are downwardly directed and received in bins 52*b*, 52*c*, . . . Incoming sheet sensor 54 detects incoming sheets P and delivers a signal that is output to controller 61, to be described.

Sheet discharging unit 51 is constituted by a feed means that feeds sheets P to a stapling zone 96 (FIG. 7), to be described.

As shown in FIG. 5, controller 61 is a control circuit provided with a CPU. A document number of sheets sensor 61*a* is constituted with a document discharge sensor 17 and is connected to controller 61. A number of sheets sensor 61*b* is constituted with an incoming sheet sensor 54 and is also connected to controller 61.

Figure 6:
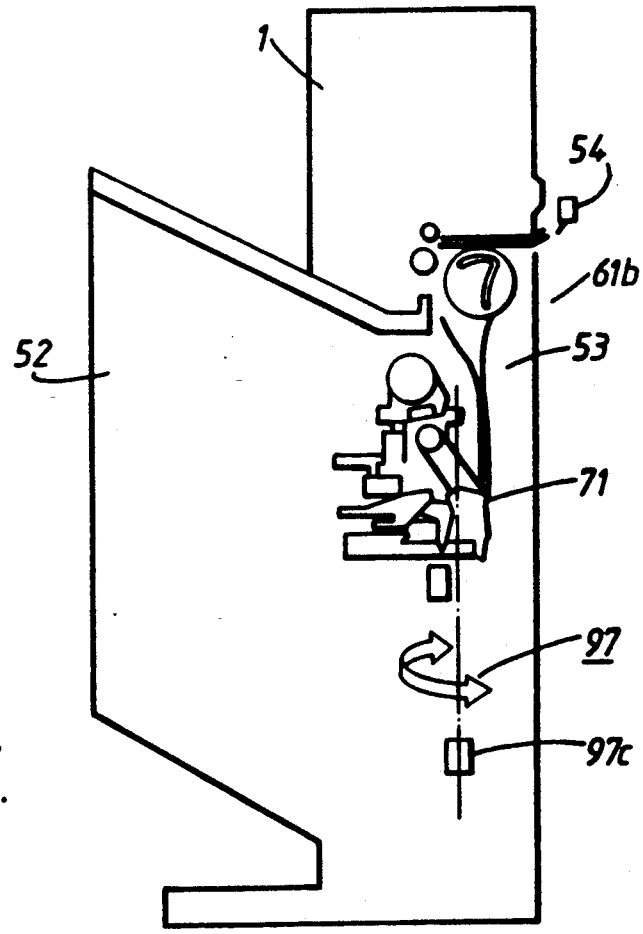
FIG. 6 is a schematic view showing the relative positions of the sheet discharging unit and stapling device.

Stapling device B will now be described with referring to FIGS. 6 to 8.

Stapling device B comprises a single stapler unit 71, anvils 85 and 86, a moving mechanism 91 that supports and moves anvils 85 and 86, a sheet guide 98 that aligns sheets P in bin unit 52, controller 61 (commonly used with main unit A) that controls these, a document number of sheets sensor 61*a*, and a number of sheets sensor 61*b*.

Stapler unit 71 has a base 74 at its bottom end, on which moving mechanism 91 is mounted. The tip of the base 74 provides an anvil mounting location 74*a*. Anvils 85 and 86 are moved to be located at location 74*a*. Also a pressing member 76 is swingably mounted on base 74.

Also, a pressing member 77 that can be advanced or retracted with respect to this anvil mounting location 74*a* is supported by a guide 78 such that pressing member 77 is vertically movable. Pressing member 77 presses a staple to pierce the sheets.

A cam shaft 79 is rotatably mounted on pressing member 76. A single stapling process is performed by one rotation of a cam which is mounted on the cam shaft 79. One rotation of cam shaft 79 is detected by means of home position cam sensor 80*a* and home position cam 81. The cam shaft 79 then stops in the home position. Rotation of this cam shaft 79 is performed by motor 82, which is connected to controller 81 by means of motor driver 82*a*.

Figure 9A:
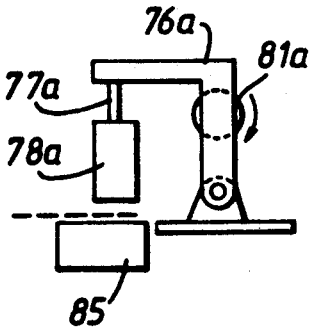
FIG. 9A to 9C are schematic views showing the operation of the stapler unit.
Figure 9B:
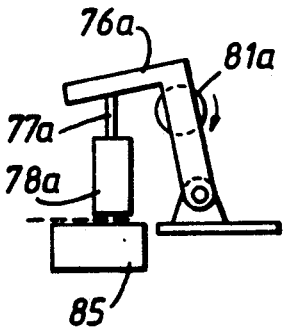
Figure 9C:
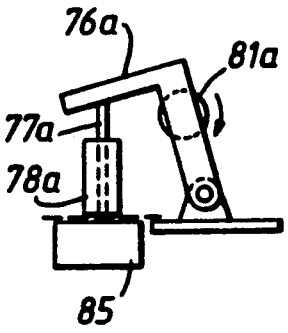

The operation of this stapler unit 71 will now be described with reference to FIGS. 9A to 9C. When cam 81*a* starts to rotate from the condition of FIG. 9A, rotation of pressing member 76*a* is transmitted through pressing member 77*a* causing guide 78*a* to descend. The sheets are then gripped between guide 78*a* and anvil 85 as shown in FIG. 9B. Further descent of pressing member 77*a* effects stapling as shown in FIG. 9C.

Figure 8:
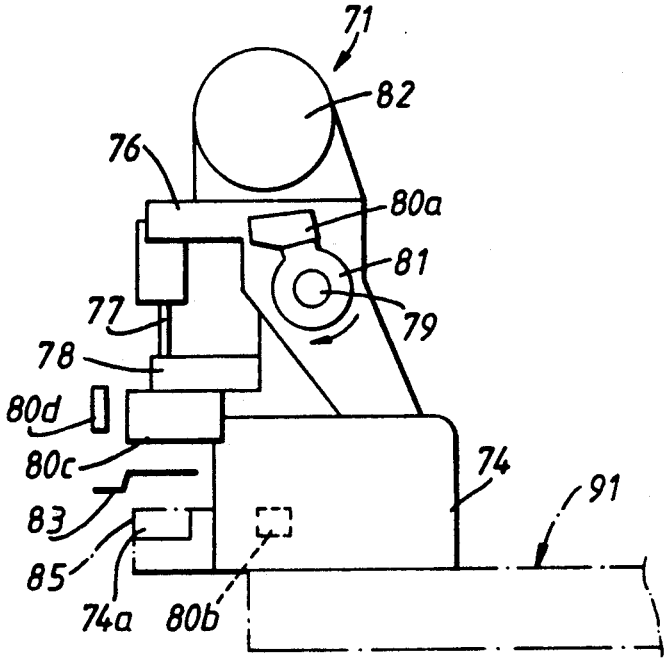
FIG. 8 is a schematic view showing a stapler unit of the stapling device.

Stapler unit 71 is further provided with various sensors as shown in FIG. 8. It is provided with: a staple sensor 80*b* that detects the staples fed to anvil mounting location 74*a*, foreign substance sensor 80*c* that detects foreign bodies by displacement of a leaf spring 83 of an actuator, and a sheet sensor 80*d* that detects the presence of the sheets. These sensors 80*b*, 80*c* and 80*d* are respectively electrically connected to controller 61.

Figure 7:
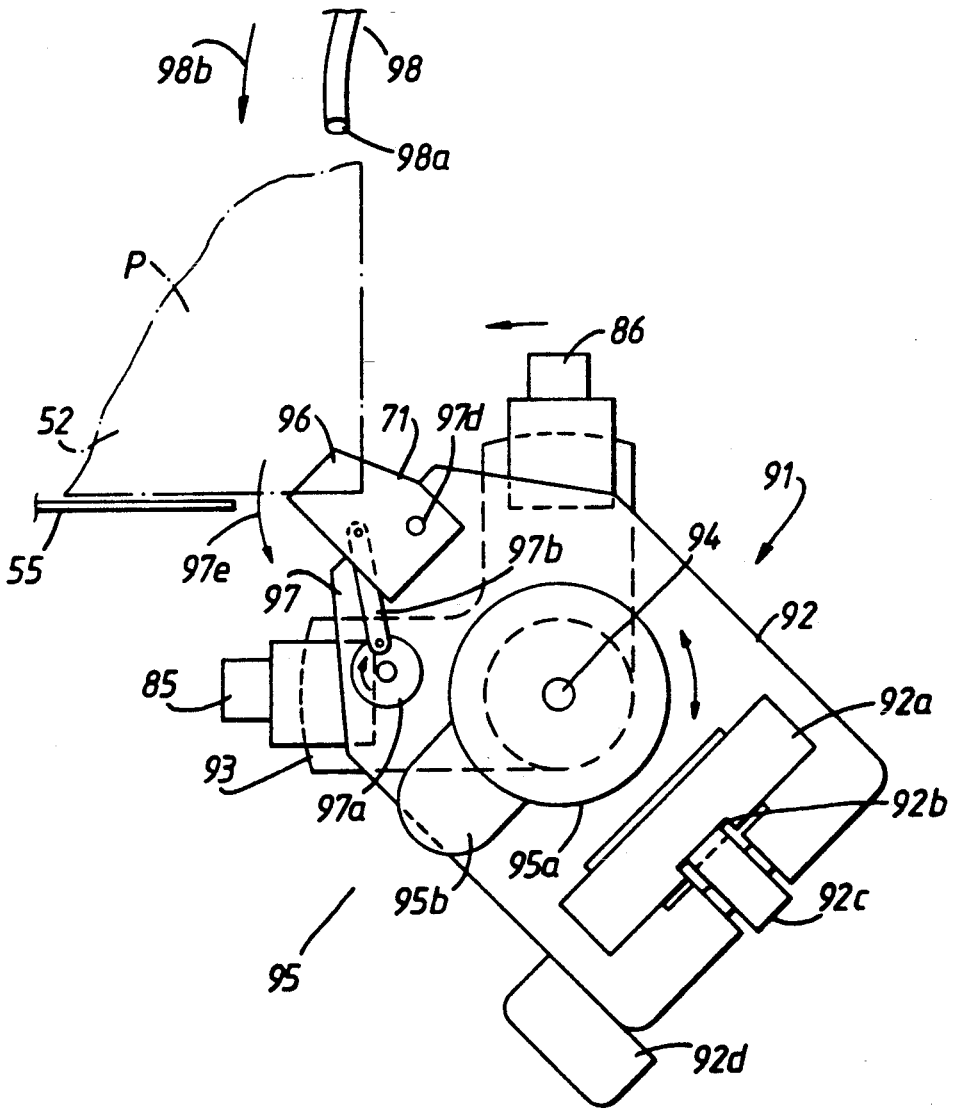
FIG. 7 is a plan view of a moving mechanism in the stapling device.

As shown in FIG. 7, anvils 85 and 86 are mounted on a changeover device 95 which shifts them to anvil mounting location 74*a* of stapler unit 71 so that they can cooperate with stapler unit 71 to effect stapling.

Figure 15:
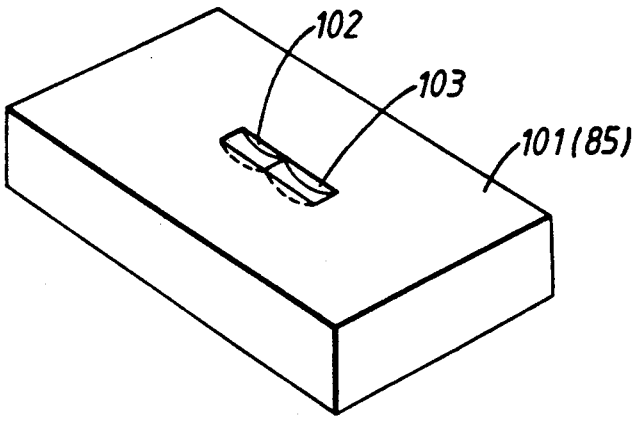
Fig.15. (PRIOR ART)
FIG. 15 is a perspective view showing an anvil used in the conventional stapling device.
Figure 16A:
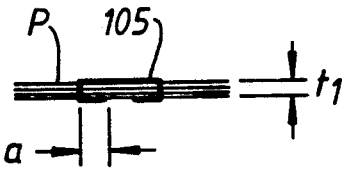
FIGS. 16A and 16B are sectional views each showing the condition of stapling the sheets by using the anvil shown in FIG. 15 With a suitable staple to which match the thickness of the sheets.
Figure 16B:
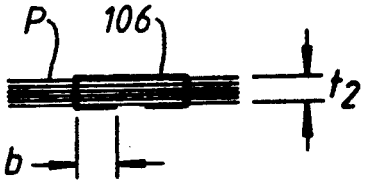
Figure 17A:
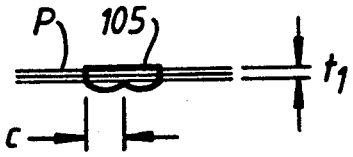
FIGS. 17A and 17B are sectional views each showing the condition of stapling the sheets by using the anvil shown in FIG. 15 with an unsuitable staple to which unmatch the thickness of the sheets.
Figure 17B:
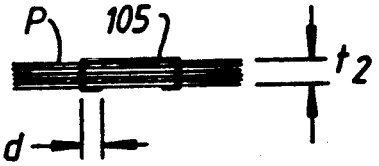

When the thickness of the stack of sheets to be stapled matches the staples that are stored in stapler unit 71, anvil 85 is selected. It is therefore of the well-known construction shown in FIG. 15 so a detailed description of it will be omitted.

Figure 10A:
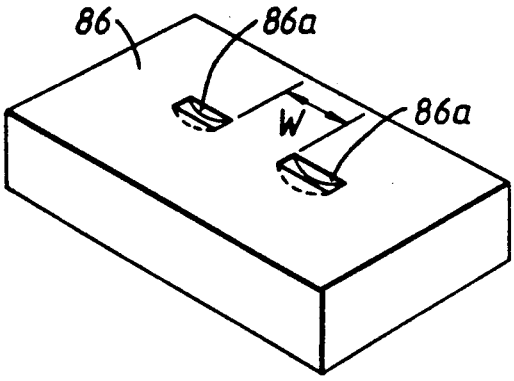
FIG. 10A is a perspective view showing an anvil used in the stapling device of the present invention.
Figure 10B:
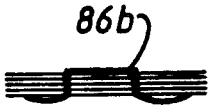
FIG. 10B is a sectional view showing the condition of stapling the sheets by using the anvil shown in FIG. 10A.

Anvil 86 is selected when there is a risk of bowing if stapling is performed with the aforementioned staples. As shown in FIG. 10A, it has a large separation between its recesses 86*a*, so that the staples are bent outwards. The tips of staple 86*b* therefore do not face each other, so, as shown in FIG. 10B, even if the stack of sheets to be stapled is of small thickness, they do not contact each other, the bowing of staple 86*b* does not occur.

Figure 11A:
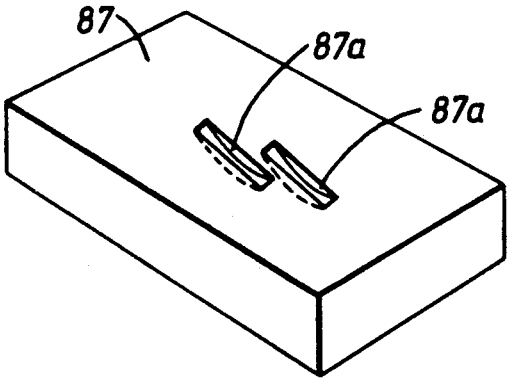
FIG. 11A is a perspective view showing an anvil of another embodiment used in the stapling device of the present invention.
Figure 11B:
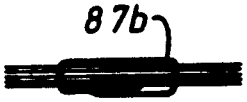
FIG. 11B is a sectional view showing the stapling of the sheets by using the anvil shown in FIG. 11A.

A further embodiment is shown in FIG. 11A. Anvil 87 in this embodiment has recesses 87*a* that are similar to the well known construction but instead of both being on the same straight line, make a slight angle, so that they are arranged parallel to each other. As a result, even if the staple ends are bent inwards, they do not face each other, but miss each other as shown in FIG. 11B. The bowing of staple 87*b* therefore does not occur.

Anvils 86 and 87, described above, will be termed non-facing-type anvils, since the tips of the staples do not face each other after stapling.

Moving mechanism 91 has a stage 92 adjacent bin unit 52. This stage 92 is mounted so that it is free to ascend and descend on a supporting pillar 92*a* erected on main body 1. This stage 92 is also provided with a pinion gear 92*c* meshing with a rack gear 92*b* provided on supporting pillar 92*a*, and with a motor 92*d* that rotates this pinion gear 92*c*. Thus stage 92 can be raised and lowered by rotation of this motor 92*d*.

An L-shaped changeover table 93 is arranged at rear face of stage 92. This changeover table 93 is fixed to a changeover shaft 94 that is rotatably supported and that passes through stage 92. Anvils 85 and 86 are mounted on this changeover table 93.

On the top face of stage 92 there is provided a changeover unit 95*a* whose output shaft is changeover shaft 94. This changeover unit 95*a* is driven by motor 95*b* to rotate changeover table 93 by 90°.

Changeover device 95 is constituted by changeover table 93, changeover unit 95*a*, and motor 95*b*.

The arrangement shown in FIG. 7 is the neutral position. If changeover table 93 rotates by 45° from the neutral position in the clockwise direction, anvil 85 is located to a stapling zone 96 as a prescribed position. If changeover table 93 rotates by 45° from the neutral position in the anticlockwise direction, anvil 86 is located to stapling zone 96. This stapling zone 96 is the location where stapling of sheets P is effected. At the neutral position, bin unit 52 and changeover table 93 are mutually separated, and bin unit 52 is free to rise and descend.

Motor 95*b* is connected to controller 61 through motor driver 96*c*.

As shown in FIG. 7, above stage 92 there is provided a stapler swinging unit 97 that swings stapling unit 71. This stapler swinging unit 97 comprises a disc member 97*a* rotatably mounted on stage 92, a linking element 97*b* that provides linkage between disc member 97*a* and stapler unit 71, and a motor 97*c* (shown in FIG. 6) that rotates disc member 97*a*. Thus stapler unit 71 is rotatable relative to bin unit 52 in the direction of arrow 97*e* about a pin 97*d* when disc member 97*a* is rotated.

Sheet guide 98 is equipped with a guide bar 98*a* that passes vertically through bin unit 52. This sheet guide 98 is operated by rotating in the direction of arrow 98*b* by a moving mechanism (not shown) to bring sheets P in bins 52*a*, 52*b*, . . . into contact with a restraining plate 55, so that sheets P are lined up in a fixed position. A motor (not shown) that effects this operation is connected to controller 61 through motor driver 98*c*.

The operation of stapling device B will now be described with reference to the flow chart shown in FIG. 12 when the stapling thickness is estimated by number of sheets sensor 61*b*.

The number of sheets P entering bin unit 52 discharging unit 51, as a conveying unit, is counted by number of sheets sensor 61*b* (step P1). The number of sheets n is found in response to a "copying completed" signal (step P2). The user is then interrogated as to whether stapling is required (step P3). If it is required, the system then ascertains whether $n \geqq N$ for a set number of sheets N (step P4). If it is no requirement to perform a stapling operation at the step P3, sheets P are discharged to bin unit 52 without stapling. If, in the step P4, the number of sheets n is larger than the set number of sheets N, controller 61 sends a command signal to changeover device 95 for selecting facing-type anvil 85. On receiving this command signal, changeover device 95 drives motor 95*b* through motor driver 96*c*, to move facing-type anvil 85 to stapling zone 96 (step P5). Then, if there is no abnormality in regard to the "presence of sheets" or the "presence of foreign bodies", motor 82 is rotated by motor driver 82*a*, effecting stapling. Cam shaft 79 rotates once and then stops (step P6).

If, in the step P4, the number of sheets n is smaller than the set number of sheets N, non-facing-type anvil 86 is selected (step P7) and stapling is thereafter performed in the same way (step P6).

When the sheets P in another bin 52*a*, . . . are to be stapled, first of all, changeover table 93 is rotated to the neutral position. Then, motor 92*d* is driven, moving stage 92 vertically until it stops facing the prescribed bin, whereupon the operation described above is repeated.

Next, the case where the desired number of copies n is used as a number of sheets detection means will be described with reference to the flow chart of FIG. 13.

The desired number of copies n is input by an operator to main unit A through operating panel 2 (step P11). Next the system ascertains whether or not stapling is to be required (step P12). If it is required to perform a stapling operation, the system checks whether $n \geqq N$ (step P3). If, in the step P13, the number of Sheets n is larger than the set number of sheets N, facing-type anvil 85 is selected (step P14) If, in the step P13, the number of sheets n is smaller than the set number of sheets N, non-facing-type anvil 86 is selected (step P17). Whichever anvil has been selected is located to stapling zone 96. When this process has been completed, the image forming operation is performed (step P15). When the copying operation is completed, stapling is performed in response to a command signal from controller 61 (step P16).

The case where the stapling thickness is estimated using document number of sheets sensor 61*a* as number of sheets detecting means will next be described with reference to the flow chart of FIG. 14.

First, in sort mode, it is ascertained whether the system is to be put into the stapling mode (step P21). If, in the stapling mode, it is ascertained whether the system is to be put into document feed mode (step P22). If in the document feed mode, document feeding unit 11 is operated, the image forming operation is executed, document discharge is detected and the operation is completed. The number of document sheets is detected by controller 61, and the stapling thickness produced by the sort mode is estimated (step P23). Subsequent operation is the same as in the case of FIG. 12, so a further description is omitted.

Another embodiment of the present invention will now be described with reference to FIG. 18.

Figure 18:
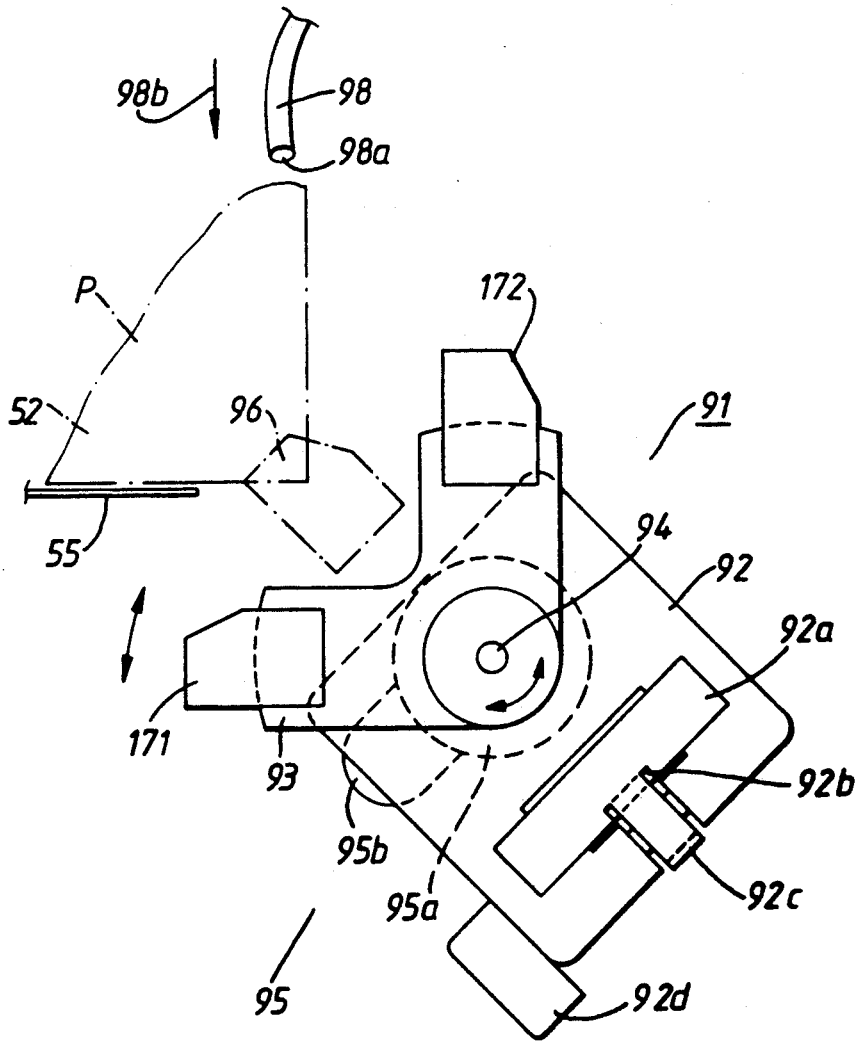
FIG. 18 is a plan view of a moving mechanism in a stapling device of another embodiment of the present invention.

As shown in FIG. 18, moving mechanism 91 has a stage 82 adjacent bin unit 52. This stage 92 is mounted so that it is free to ascend and descend on a supporting pillar 92*a* erected on main body 1. This stage 92 is also provided with a pinion gear 92*c* meshing with a rack gear 92*b* provided on supporting pillar 92*a*, and with a motor 92*d* that rotates this pinion gear 92*c*. Thus stage 92 can be raised and lowered by rotation of this motor 92*d*.

An L-shaped changeover table 93 is arranged at top face of stage 92. This changeover table 93 is fixed to a changeover shaft 94 that is rotatably supported and that passes through stage 92. A first stapling unit 171 and second stapling unit 171 are mounted on this changeover table 93.

At the rear face of stage 92 there is provided a changeover unit 95*a* whose output shaft is changeover shaft 94. This changeover unit 95*a* is driven by motor 95*b* to rotate changeover table 93 by 90°.

Changeover device 95 is constituted by changeover table 93, changeover unit 95*a*, and motor 95*b*.

Small size staples are accommodated in first stapling unit 171 and large size staples are accommodated in second stapling unit 172. Thus, first and second stapling units 171 and 172 are selectably operated in accordance with the thickness of the sheaf of sheets which is detected by the detecting means. If the thickness of the sheaf of sheets is detected as small, first stapling unit 171 is selected to staple the thin sheaf of sheets. If the thickness of the sheaf of sheets is detected as large, second stapling unit 172 is selected to staple the thick sheaf of sheets.

Figure 12:
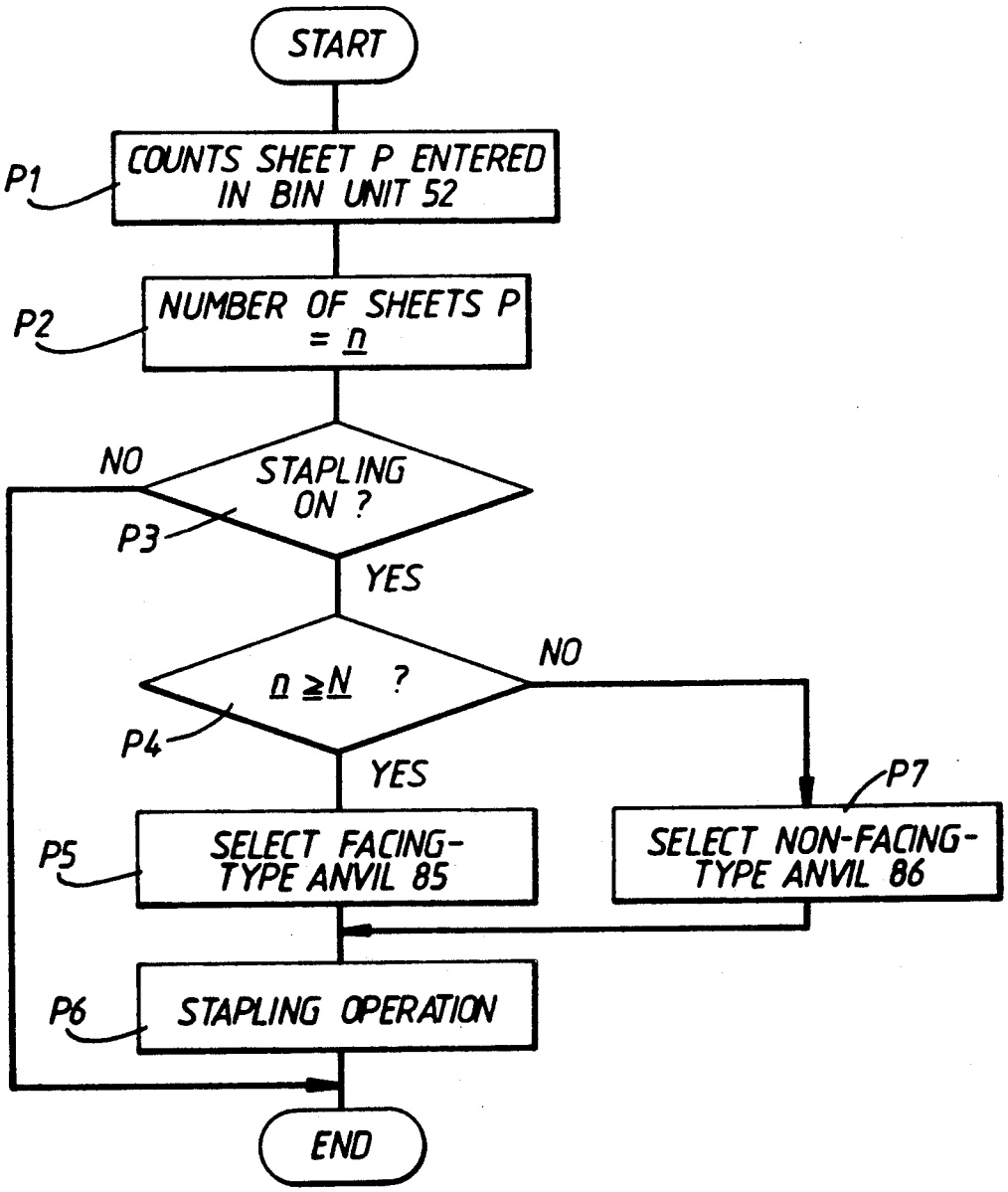
FIG. 12 to 14 are flow charts intended to explain the operation of the stapling device equipped with the image forming apparatus according to the present invention.
Figure 13:
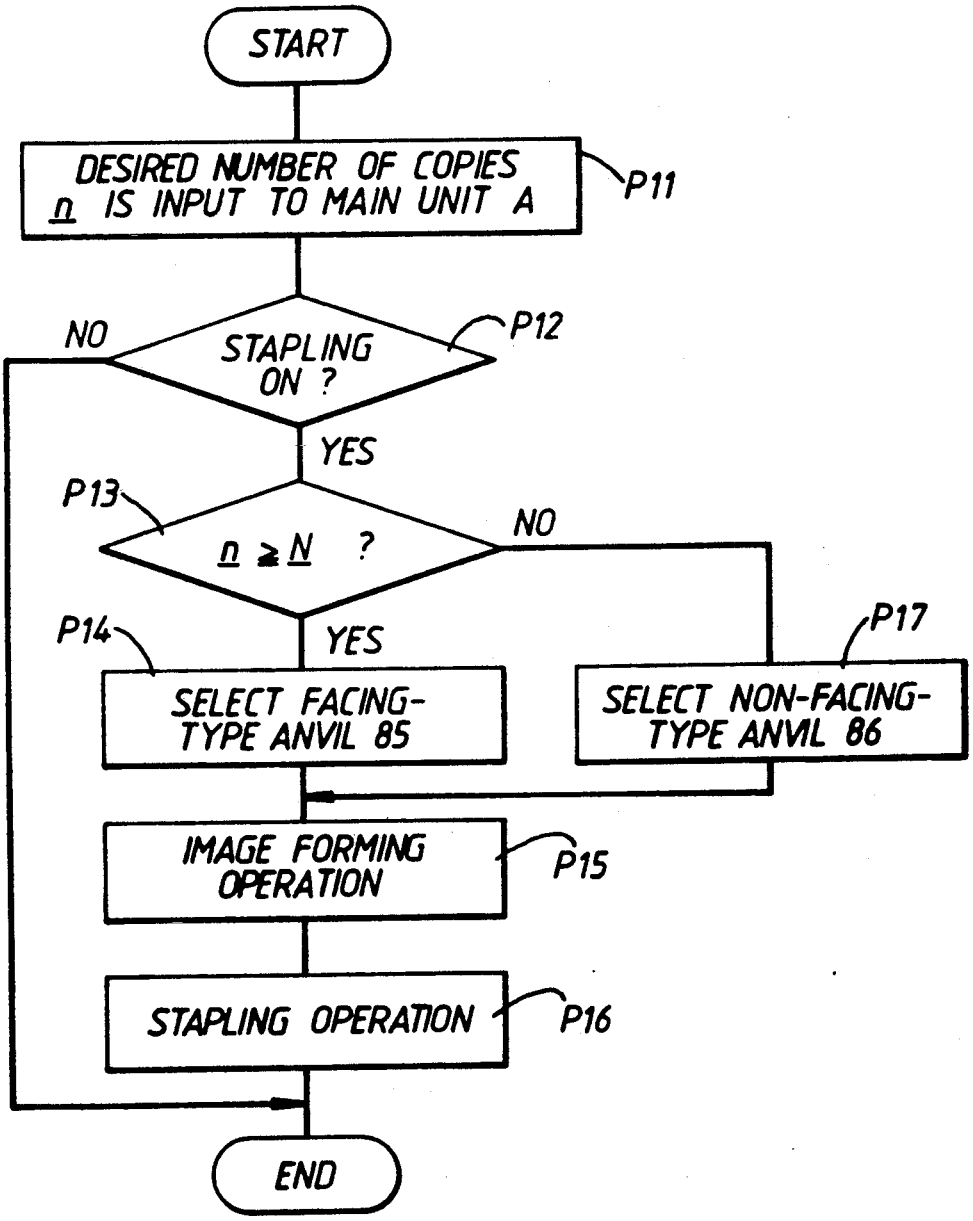
Figure 14:
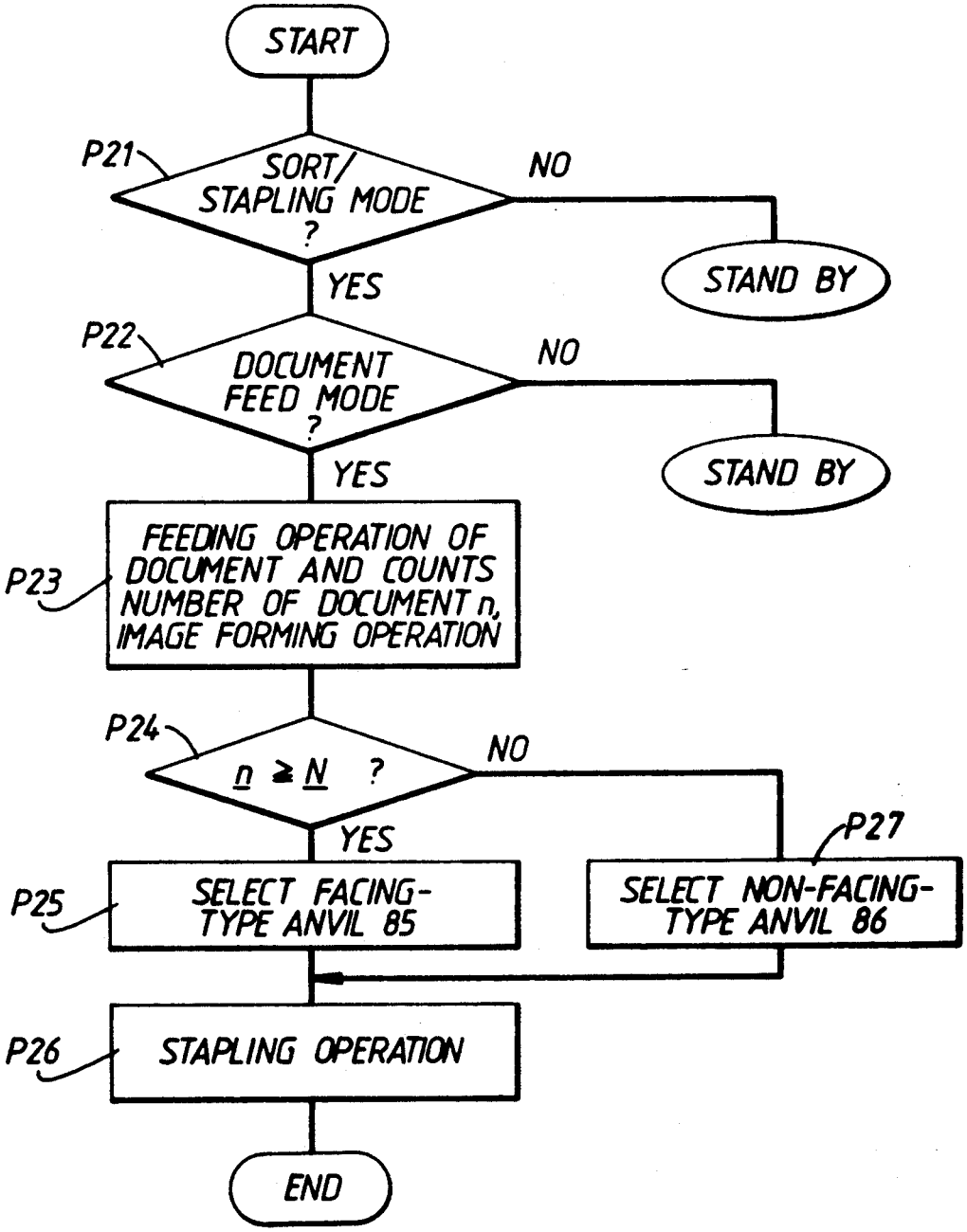

The operation of the stapling device described above as another embodiment is almost same with the first embodiment of the present invention referring to FIGS. 12 to 14 so a detailed description of it will be omitted.

As described in detail above, the stapling device of the present invention is provided with a facing-type anvil and a non-facing-type anvil, the stapling thickness being detected and used to select an anvil which is adapted to this thickness. It is therefore possible to achieve stapling with no bowing of staple or detachment of sheets even when these thicknesses are not the same.

Further, as described above, the stapling device of the present invention is provided with a plurality of stapling units in each of Which different size staples is accommodated, the stapling thickness being detected and used to select a stapling unit which is adapted to this thickness. It is therefore possible to achieve suitable stapling even when these thicknesses are not the same.

What is claimed is:

1. A device for stapling sheets at a stapling zone by using staples having one size, comprising:

means for conveying the sheets to collate the sheets at the stapling zone;

means for detecting the overall thickness of sheets conveyed by the conveying means to the stapling zone;

means for pressing the staple to pierce the sheets;

first anvil means for bending the staple inwardly, which staple is pressed and pierces the sheets by the pressing means, so that the tips of the staple face each other to staple the sheets collated at the stapling zone;

second anvil means for bending the staple, which staple is pressed and pierces the sheets by the pressing means, to form the tips of the staple in a non-facing configuration to staple the sheets collated at the stapling zone; and means for alternatively selecting one of the first or second anvil means to cooperate with the pressing means in accordance with the overall thickness of sheets detected by the detecting means.

2. The device of claim 1, wherein the selecting means selects the first anvil means when the detecting means detects that the overall thickness of sheets is larger than a prescribed thickness.

3. The device of claim 1, wherein the selecting means selects the second anvil means when the detecting means detects that the overall thickness of sheets is smaller than a prescribed thickness.

4. An image forming apparatus comprising:

means for forming an image of a document on a sheet;

means for designating a desired number of sheets to be formed with images thereon;

means for forming images on each of the desired number of sheets;

means for conveying the sheets on which the images ar formed to be collated at a stapling zone;

first stapler means for stapling a set of sheets collated at the stapling zone, the first stapler means including means for pressing a staple to pierce the sheets and anvil means for bending the staple inwards so that the tips of the staple face each other;

second stapler means for stapling a set of sheets collated at the stapling zone, the second stapler means including means for pressing a staple to pierce the sheets and anvil means for bending the staple to form the tips of the staple in a non-facing configuration; and means responsive to the designating means for selecting one of the first and second stapler means in accordance with the desired number of sheets designated by the designating means, wherein the selecting means selects the first stapler means when the designating means designates a desired number of sheets that exceed a prescribed number and selects the second stapler means when the designating means designates the desire number of sheets less than a prescribed number.

5. An image forming apparatus including means for feeding documents, and means for forming an image of the document on a sheet, the apparatus comprising:

means for conveying the sheets on which images are formed, to be collated at the stapling zone;

means for detecting the number of documents conveyed by the conveying means, to determine the overall thickness of sheets collated at the stapling zone;

first stapler means for stapling the sheets collated at the stapling zone, the first stapler means including means for pressing a staple to pierce the sheets and anvil means for bending the staple tips inward so that the tips of the staple face each other;

second stapler means for stapling the sheets collated at the stapling zone, the second stapler means including means for pressing a staple to pierce the sheets and anvil means for bending the staple to form the tips of the staple in a non-facing configuration; and means for selecting one of the first and second stapler means in accordance with the overall thickness of sheets, as determined by the detecting means, wherein the selecting means selects the first stapler means when the detecting means determines that the overall thickness of the sheets is larger than a prescribed thickness and selects the second stapler means when the detecting means determines that the overall thickness of the sheets is smaller than a prescribed thickness.

* * * * *